US011346043B2

(12) United States Patent
Prajescu et al.

(10) Patent No.: US 11,346,043 B2
(45) Date of Patent: May 31, 2022

(54) DRYER APPLIANCE AND A METHOD OF OPERATING THE SAME IN RESPONSE TO RESTRICTED AIR FLOW

(71) Applicant: Haier US Appliance Solutions, Inc., Wilmington, DE (US)

(72) Inventors: Ionelia Silvia Prajescu, Louisville, KY (US); Joshua L. Reeves, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 61 days.

(21) Appl. No.: 16/926,175

(22) Filed: Jul. 10, 2020

(65) Prior Publication Data

US 2022/0010479 A1 Jan. 13, 2022

(51) Int. Cl.

| | |
|---|---|
| ***F26B 3/00*** | (2006.01) |
| ***D06F 58/50*** | (2020.01) |
| ***D06F 58/38*** | (2020.01) |
| ***D06F 58/30*** | (2020.01) |
| *D06F 103/32* | (2020.01) |
| *D06F 105/20* | (2020.01) |
| *D06F 103/36* | (2020.01) |
| *D06F 105/56* | (2020.01) |

(52) U.S. Cl.

CPC ..... *D06F 58/50* (2020.02); *D06F 58/30* (2020.02); *D06F 58/38* (2020.02); *D06F 2103/32* (2020.02); *D06F 2103/36* (2020.02); *D06F 2105/20* (2020.02); *D06F 2105/56* (2020.02)

(58) Field of Classification Search

CPC ..... D06F 58/50; D06F 58/30; D06F 58/38; D06F 2103/32; D06F 2103/36; D06F 2105/20; D06F 2105/56

USPC ..... 34/499

See application file for complete search history.

(56) References Cited

U.S. PATENT DOCUMENTS

| | | | | |
|---|---|---|---|---|
| 7,913,418 | B2 | 3/2011 | Carow | |
| 10,184,208 | B2 | 1/2019 | Terenzio | |
| 2003/0230005 | A1* | 12/2003 | Lapierre | D06F 34/26 34/606 |
| 2014/0250716 | A1* | 9/2014 | Prajescu | D06F 58/38 34/443 |
| 2016/0076193 | A1* | 3/2016 | Santillan Galvan | G05B 15/02 700/275 |

FOREIGN PATENT DOCUMENTS

| | | | |
|---|---|---|---|
| EP | 0106646 | A2 | 4/1984 |
| EP | 2811064 | A1 | 12/2014 |

* cited by examiner

*Primary Examiner* — John P McCormack
(74) *Attorney, Agent, or Firm* — Dority & Manning, P.A.

(57) ABSTRACT

A method for operating a dryer appliance includes obtaining an initial operating temperature, obtaining a first temperature set point and a second temperature set point lower than the first temperature set point, wherein the first temperature set point and the second temperature set point are based at least in part on the initial operating temperature, operating the dryer appliance at the initial operating temperature, determining that a restriction level within the dryer appliance exceeds a restriction threshold, and operating the dryer appliance at the first temperature set point, lower than the initial operating temperature, upon determining that the restriction level exceeds the restriction threshold.

18 Claims, 6 Drawing Sheets

DRYER APPLIANCE AND A METHOD OF OPERATING THE SAME IN RESPONSE TO RESTRICTED AIR FLOW

FIELD OF THE INVENTION

The present subject matter relates generally to dryer appliances, and more particularly to methods for operating a dryer appliance based on restricted air flow.

BACKGROUND OF THE INVENTION

Certain dryer appliances include a cabinet with a drum rotatably mounted therein. A heating assembly, such as an electric resistance heating element or a gas burner, can supply heated air to a chamber of the drum. For example, certain dryer appliances include a duct mounted to a back wall of the drum. The duct can direct heated air from the heating assembly into the chamber of the drum during operation of the dryer appliance. The duct generally includes an inlet that receives heated air from the heating assembly and a plurality of outlets for directing such heated air into the chamber of the drum. In particular, the back wall of the drum can define an opening, and outlets of the duct can be positioned such that heated air from the duct enters the chamber through the back wall's opening. Such heated air can assist with drying articles located within the drum's chamber.

Heated air exiting the duct's outlets is preferably maintained below a certain threshold temperature, e.g., to avoid damaging articles that are drying within the chamber of the drum and other overheating problems. Certain dryer appliances are equipped with temperature sensors for monitoring the temperature of heated air entering the drum's chamber. If the temperature sensor detects overly hot air entering the drum's chamber, the heating assembly can be deactivated or cycled. Such cycling can negatively affect performance of the dryer appliance by increasing drying times.

Dryer appliances generally have a single threshold temperature for regulating air temperature at the duct's outlets. However, dryer appliances can experience a range of flow restrictions depending upon the installation of the dryer appliance. For example, long vent conduits and lent buildup therein can increase the dryer appliance's flow restriction. Operating the dryer appliance at a single threshold temperature for both restricted and unrestricted conditions can have several drawbacks. In particular, the threshold temperature is preferably selected to prevent the dryer appliance from overheating in restricted conditions, but such a threshold temperature can result in the dryer appliance's heating assembly unnecessarily cycling in unrestricted conditions. Such cycling can increase drying times of the dryer appliance and negatively affect dryer appliance performance.

Accordingly, a dryer appliance with features for improving performance of the dryer appliance would be useful. In particular, a dryer appliance with features for limiting cycling of a heating assembly of the dryer appliance in certain conditions would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method for operating a dryer appliance is provided. The method includes obtaining an initial operating temperature, obtaining a first temperature set point lower than the initial operating temperature, wherein the first temperature set point is based at least in part on the initial operating temperature, and operating the dryer appliance at the initial operating temperature. The method further includes determining a restriction level within the dryer appliance, determining that the restriction level exceeds a restriction threshold while operating the dryer appliance at the initial operating temperature, and operating the dryer appliance at the first temperature set point upon determining that the restriction level exceeds the restriction threshold while operating the dryer appliance at the initial operating temperature.

In another exemplary embodiment of the present disclosure, a dryer appliance is provided. The dryer appliance may include a cabinet, a drum rotatably mounted within the cabinet, the drum defining a chamber for receipt of laundry items, a heater for heating an air supply, a duct fluidly connecting the heater and the drum, a temperature sensor positioned within the duct proximate the drum, and a controller in operative communication with the heating assembly and the temperature sensor. The controller may be configured for obtaining an initial operating temperature, obtaining a first temperature set point and a second temperature set point lower than the first temperature set point, wherein the first temperature set point and the second temperature set point are based at least in part on the initial operating temperature, and operating the dryer appliance at the initial operating temperature. The controller may be further configured for determining a restriction level within the dryer appliance, determining that the restriction level exceeds a first restriction threshold while operating the dryer appliance at the initial operating temperature; and operating the dryer appliance at the first temperature set point upon determining that the restriction level exceeds the first restriction threshold while operating the dryer appliance at the initial operating temperature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
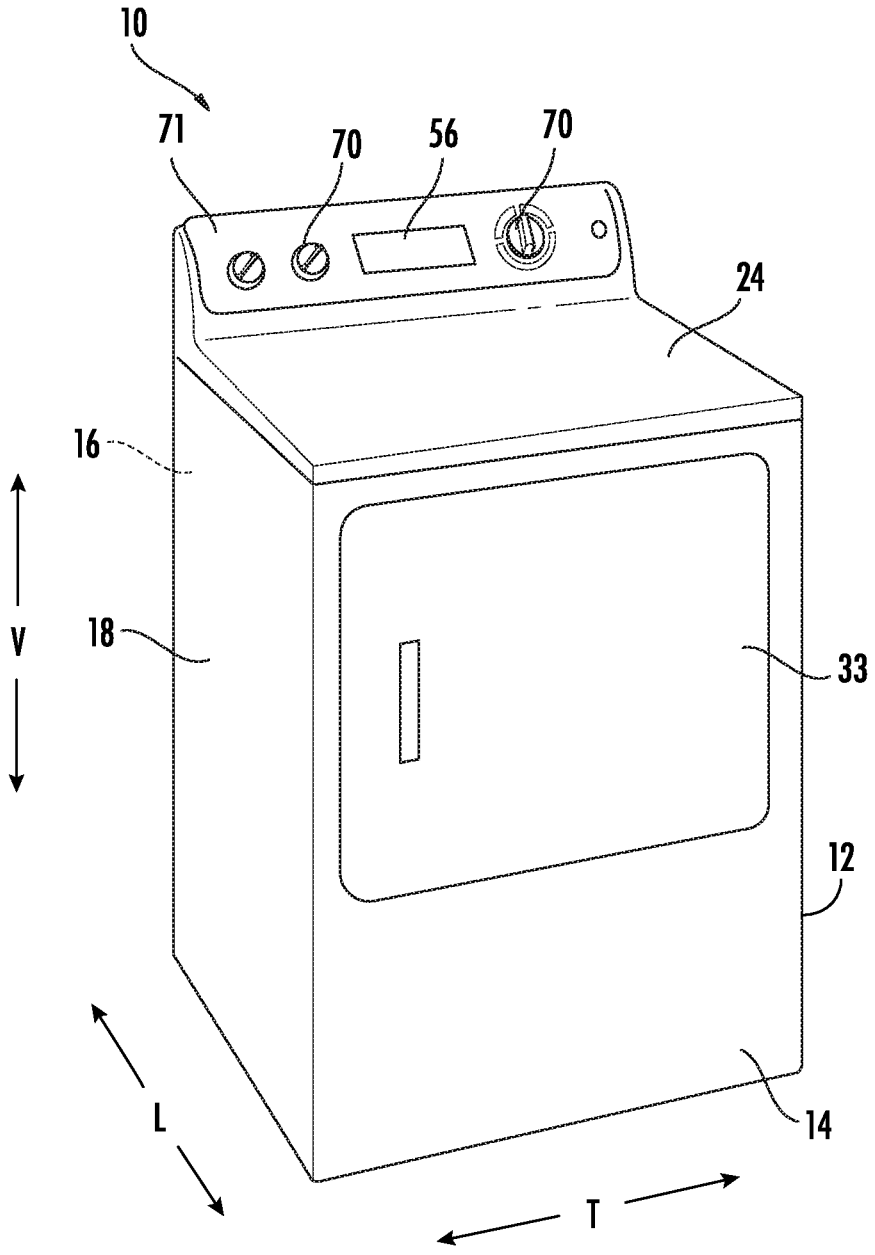
FIG. 1 provides a perspective view of a dryer appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
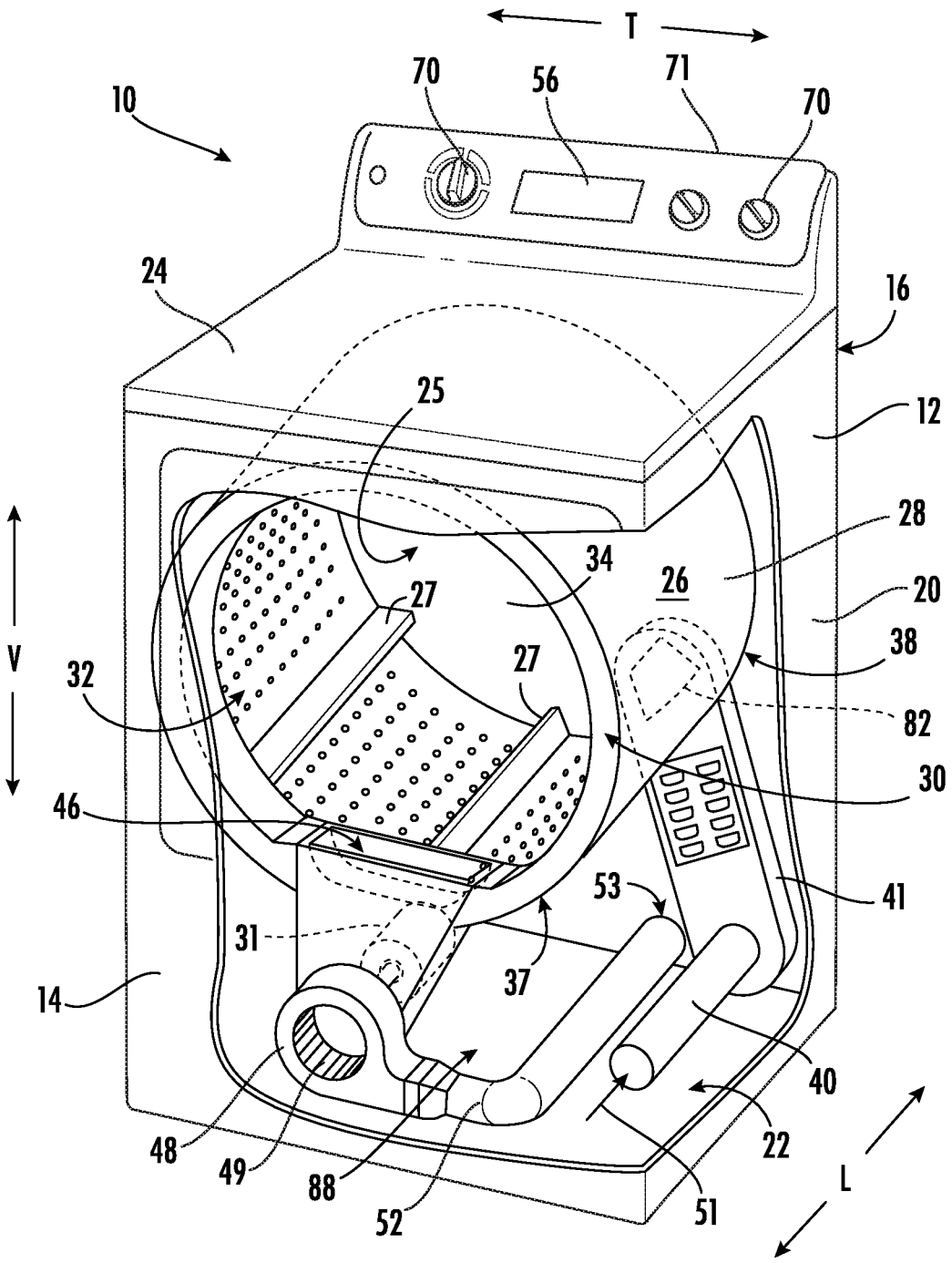
FIG. 2 provides a perspective view of the dryer appliance of FIG. 1 with portions of a cabinet of the dryer appliance removed to reveal certain components of the dryer appliance.

FIG. 1 illustrates a dryer appliance 10 according to an exemplary embodiment of the present subject matter. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. Dryer appliance 10 defines a vertical direction V, a lateral direction L, and a transverse direction T. The vertical direction V, lateral direction L, and transverse direction T are mutually perpendicular and form an orthogonal direction system.

Cabinet 12 includes a front panel 14, a rear panel 16, a pair of side panels 18 and 20 spaced apart from each other by front and rear panels 14 and 16, a bottom panel 22, and a top cover 24. Within cabinet 12 is a drum or container 26 mounted for rotation about a substantially horizontal axis, e.g., that is parallel or substantially parallel to the lateral direction L. Drum 26 defines a chamber 25 for receipt of articles, e.g., clothing, linen, etc., for drying. Drum 26 extends between a front portion 37 and a back portion 38, e.g., along the lateral direction L.

A motor 31 is configured for rotating drum 26 about the horizontal axis, e.g., via a pulley and a belt (not shown). Drum 26 is generally cylindrical in shape, having an outer cylindrical wall or cylinder 28 and a front flange or wall 30 that defines an entry 32 of drum 26, e.g., at front portion 37 of drum 26, for loading and unloading of articles into and out of chamber 25 of drum 26. A plurality of tumbling ribs 27 are provided within chamber 25 of drum 26 to lift articles therein and then allow such articles to tumble back to a bottom of drum 26 as drum 26 rotates. Drum 26 also includes a back or rear wall 34, e.g., at back portion 38 of drum 26. Cylinder 28 is rotatable on rear wall 34 as will be understood by those skilled in the art. A duct 41 is mounted to rear wall 34 and receives heated air that has been heated by a heating assembly or system 40.

Motor 31 is also in mechanical communication with an air handler 48 such that motor 31 rotates a fan 49, e.g., a centrifugal fan, of air handler 48. Air handler 48 is configured for drawing air through chamber 25 of drum 26, e.g., in order to dry articles located therein as discussed in greater detail below. In alternative exemplary embodiments, dryer appliance 10 may include an additional motor (not shown) for rotating fan 49 of air handler 48 independently of drum 26.

Drum 26 is configured to receive heated air that has been heated by a heating assembly 40, e.g., in order to dry damp articles disposed within chamber 25 of drum 26. Heating assembly 40 includes a heating element (not shown), such as a gas burner or an electrical resistance heating element, for heating air. As discussed above, during operation of dryer appliance 10, motor 31 rotates drum 26 and fan 49 of air handler 48 such that air handler 48 draws air through chamber 25 of drum 26 when motor 31 rotates fan 49. In particular, ambient air enters heating assembly 40 via an entrance 51 due to air handler 48 urging such ambient air into entrance 51. Such ambient air is heated within heating assembly 40 and exits heating assembly 40 as heated air. Air handler 48 draws such heated air through duct 41 to drum 26. The heated air enters drum 26 through an outlet 82 of duct 41 positioned at rear wall 34 of drum 26.

Within chamber 25, the heated air can accumulate moisture, e.g., from damp articles disposed within chamber 25. In turn, air handler 48 draws humid air through a screen filter (not shown) which traps lint particles. Such humid air then enters an exit conduit 46 and is passed through air handler 48 to an exhaust conduit 52. From exhaust conduit 52, such humid air passes out of dryer appliance 10 through a vent 53 defined by cabinet 12. After the clothing articles have been dried, they are removed from the drum 26 via entry 32. A door 33 provides for closing or accessing drum 26 through entry 32.

A cycle selector knob 70 is mounted on a cabinet backsplash 71 and is in communication with a processing device or controller 56. Signals generated in controller 56 operate motor 31 and heating assembly 40 in response to the position of selector knobs 70. Alternatively, a touch screen type interface, knobs, sliders, buttons, speech recognition, etc., mounted to cabinet backsplash 71 can permit a user to input control commands for dryer appliance 10 and/or controller 56.

Controller 56 may include memory and one or more processing devices such as microprocessors, CPUs or the like, such as general or special purpose microprocessors operable to execute programming instructions or micro-control code associated with operation of dryer appliance 10. The memory can represent random access memory such as DRAM, or read only memory such as ROM or FLASH. The processor executes programming instructions stored in the memory. The memory may be a separate component from the processor or may be included onboard within the processor. Alternatively, controller 56 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 3:
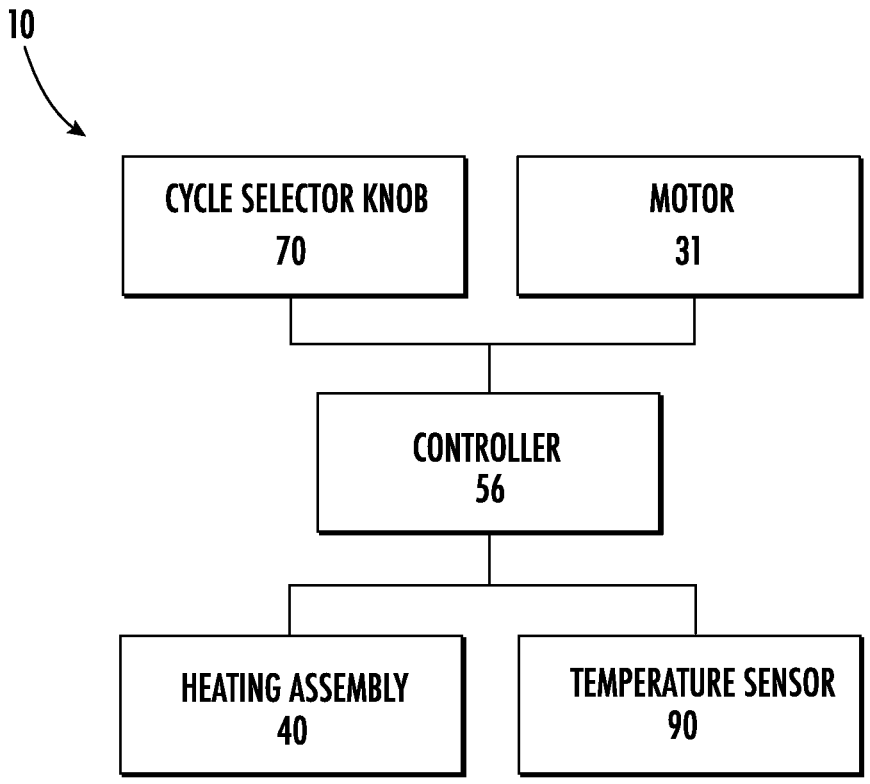
FIG. 3 provides a schematic view of certain components of the dryer appliance of FIG. 1.

FIG. 3 provides a schematic view of certain components of dryer appliance 10. As may be seen in FIG. 3, controller 56 is in operative communication with various components of dryer appliance 10. In particular, controller 56 is in operative communication with motor 31 and heating assembly 40. Thus, upon receiving an activation signal from cycle selector knob 70, controller 56 can activate motor 31 to rotate drum 26 and fan 49 of air handler 48. Controller 56 can also activate heating assembly 40 in order to generate heated air for drum 26, e.g., in the manner described above.

Controller 56 is also in communication with a thermal or temperature sensor 90, e.g., a thermocouple or thermistor. Temperature sensor 90 is configured for measuring a temperature of heated air within duct 41. Temperature sensor 90 can be positioned at any suitable location within dryer appliance 10. For example, temperature sensor 90 may be positioned within or on duct 41. Controller 56 can receive a signal from temperature sensor 90 that corresponds to a temperature measurement of heated air within duct 41, e.g., a temperature measurement of heated air exiting duct 41 at outlet 82.

Dryer appliance 10 also includes features for improving performance of dryer appliance 10. In particular, dryer appliance 10 includes features for limiting cycling of heating assembly 40 of dryer appliance 10. Such features are discussed in greater detail below.

As will be understood by those skilled in the art, dryer appliance 10 can be installed at various locations. The particular arrangement and setup of dryer appliance 10 at such locations can affect performance of dryer appliance 10. For example, a conduit (not shown) can be attached to vent 53 (FIG. 2) of dryer appliance 10 and receive moisture saturated air therefrom. The conduit can direct such moisture saturated air out of a building housing dryer appliance 10. Thus, the conduit assists dryer appliance 10 with drying articles. However, the length of conduit can affect performance of dryer appliance 10. For example, if the conduit is relatively long, it can be more difficult for air handler 48 to urge air out of vent 53 and through the conduit. Conversely, it can be relatively easier for air handler 48 to urge air out of vent 53 and through the conduit if the conduit is relatively short. The length of the conduit can vary depending upon the location of dryer appliance 10 within building. Thus, if dryer appliance 10 is located near an exterior wall, the conduit can be relatively short. Conversely, the conduit can be relatively long if dryer appliance 10 is distant from the exterior wall.

In a similar manner, lint and other debris within the conduit can also affect performance of dryer appliance 10. For example, if the conduit has a relatively large volume of debris therein, it can be more difficult for air handler 48 to urge air out of vent 53 and through the conduit. Conversely, it can be relatively easier for air handler 48 to urge air out of vent 53 and through the conduit if the conduit has a relatively small volume of debris therein. Notably, any such restrictions in the flow of air through dryer appliance 10 may limit the circulation of heat generated by heating assembly 40, thus resulting in localized heat build-up and dangerous operating conditions.

Accordingly, the length of the conduit, the volume of debris within the conduit, and other factors can affect performance of dryer appliance 10. When such factors negatively affect performance of dryer appliance 10 to a significant degree, dryer appliance 10 is operating in a restricted condition. Specifically, as used herein, the term "restricted condition" or the like may generally refer to any operating condition of dryer appliance where a flow restriction is present and such flow restriction makes it desirable to adjust the operation of dryer appliance 10, such as described herein. Conversely, dryer appliance 10 is operating in an unrestricted condition when such factors do not affect performance of dryer appliance 10 to a significant degree. As an example, when the conduit is relatively long and/or the conduit contains a relatively large volume of debris, dryer appliance 10 is operating in the restricted condition. Conversely, dryer appliance 10 is operating in the unrestricted condition when the conduit is relatively short and/or the conduit contains a relatively small volume of debris.

To assist with improving performance of dryer appliance 10, controller 56 can determine an operating condition of dryer appliance 10. In particular, controller 56 can determine whether the operating condition of dryer appliance 10 is the restricted condition or the unrestricted condition. For example, controller 56 can calculate a temperature change for heated air within duct 41 between a first time and a second time. Additionally or alternatively, controller 56 can calculate the amount of time taken for a temperature to increase from a first predetermined value (e.g., a first predetermined operating temperature) to a second predetermined value (e.g., a second predetermined operating temperature). Controller 56 can determine that dryer appliance 10 is operating in the restricted condition or the unrestricted condition based at least in part on the temperature change for the heated air between the first and second times. According to alternative embodiments, any suitable rate of change of the flow of heated air within dryer appliance 10, measured at any suitable location, may be used to determine whether dryer appliance 10 is experiencing a restricted or unrestricted condition. In particular, controller 56 can determine that dryer appliance 10 is operating in the restricted condition if the temperature change for the heated air is greater than a threshold value between the first and second times. Conversely, controller 56 can determine that dryer appliance 10 is operating in the unrestricted condition if the temperature change for the heated air is less than the threshold value between the first and second times. It should be appreciated that the thresholds for identifying restricted or unrestricted conditions may vary, may be set by a user or the manufacturer, may be calculated by controller 56, etc.

Controller 56 can also select an operating temperature of dryer appliance 10 based at least in part on the operating condition of dryer appliance 10. For example, controller 56 can select the operating temperature of dryer appliance 10 from a first temperature set point and a second temperature set point. The first and second temperature set points are different than each other. For example, the first temperature set point may correspond to a maximum operating temperature of dryer appliance 10 upon determining a restriction level exceeds a restriction threshold a first time. The second temperature set point may correspond to the maximum operating temperature of dryer appliance 10 upon determining a restriction level a second time. In other words, while the controller 56 operates dryer appliance 10 at the first temperature set point, controller 56 may determine that the restriction level exceeds the restriction threshold a second time. The controller 56 may then operate the dryer appliance at the second temperature set point lower than the first temperature set point. Thus, controller 56 selects the first temperature set point if the restricted level is determined a first time, and controller 56 selects the second temperature set point if the restricted level is determined a second time. By selecting the maximum operating temperature of dryer appliance 10 based upon the operating condition of dryer appliance 10, performance of dryer appliance 10 can be improved.

As will be understood by those skilled in the art, the temperature of the heated air flowing out of duct 41 is preferably maintained below a certain threshold temperature, e.g., about four hundred degrees Fahrenheit, in order to avoid damaging articles drying within chamber 25 and other problems. When the temperature of the heated air flowing out of duct 41 exceeds the threshold temperature, controller 56 can cycle the heating assembly 40 by reducing a power output of heating assembly 40 or deactivating heating assembly 40 in order to reduce the temperature of the heated air flowing out of duct 41.

In the unrestricted condition, a volume of heated air flowing out of duct 41 can be relatively high, and a temperature of the heated air can be relatively low. Conversely, in the restricted condition, the volume of heated air flowing out of duct 41 can be relatively low, and the temperature of the heated air can be relatively high. By selecting the maximum operating temperature of dryer appliance 10 based upon the operating condition of dryer appliance 10, unnecessary cycling of dryer appliance 10 can be avoided or limited.

Figure 4:
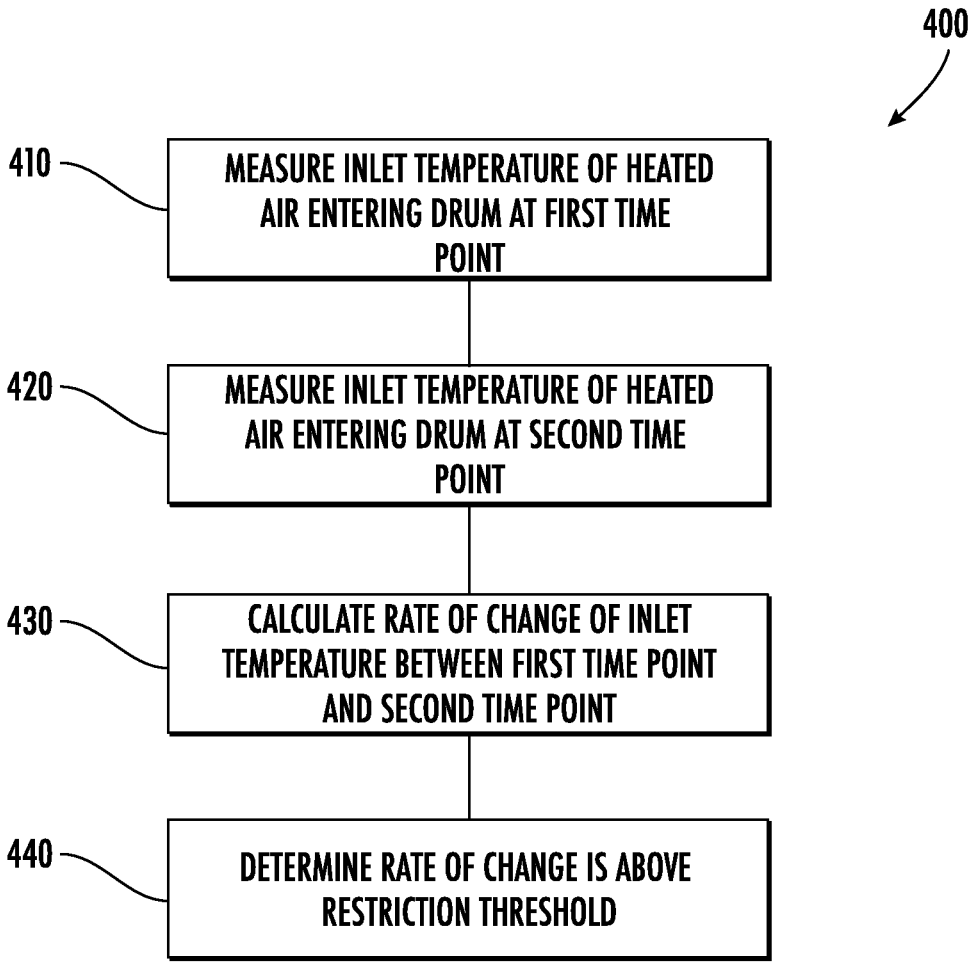
FIG. 4 provides a flow chart illustrating a method of operating the exemplary dryer appliance of FIG. 1.

FIG. 4 illustrates an exemplary method 400 of operating a dryer appliance according to an exemplary embodiment of the present subject matter. Method 400 may be used to operate any suitable dryer appliance. For example, method 400 may be used to operate dryer appliance 10 of FIG. 1. In particular, controller 56 may be programmed to implement method 400.

At 410, the method 400 includes measuring an inlet temperature of heated air entering the drum at a first time point. The temperature sensor may be located at any appropriate position within or on the duct. In one example, the temperature sensor is located proximate the outlet. As such, the temperature sensor may provide accurate temperature readings for the heated air entering the drum. The controller may receive and store the temperature reading from the temperature sensor at a first time point. At 420, the method 400 includes measuring the inlet temperature of heated air entering the drum at a second time point. The inlet temperature may be measured in the same way at the second time point as at the first time point. The second time point may be a predetermined amount of time (e.g., a first predetermined amount of time) after the first time point. For example, the second time point may be ten to sixty second after the first time point.

At 430, the method 400 includes calculating a rate of change of the inlet temperature between the first time point and the second time point. The controller may calculate the difference between the inlet temperature at the second time point and the inlet temperature at the first time point. The difference may then be compared to the predetermined amount of time between the first time point and the second time point (e.g., ten to sixty seconds). Alternatively, any other suitable method for monitoring the rate of change of inlet temperature may be used while remaining within the scope of the present subject matter, e.g., other mathematical methods, analysis, etc. At 440, the method 400 includes determining the rate of change is above a restriction threshold. The restriction threshold may be preprogrammed into the controller. The restriction threshold may be predetermined or selected by a user. The restriction threshold may be between 100° F. per minute and 200° F. per minute.

The method 400 may be performed a plurality of times throughout a drying cycle. For instance, during a first performance of method 400, the first time point may be a time point at which the drying cycle is initiated. The second time point may be the predetermined amount of time after the first time point (e.g., thirty to sixty seconds). After the controller determined the rate change is above the restriction threshold, the method 400 may be repeated. For example, the temperature sensor may measure the inlet temperature of heated air entering the drum of the dryer appliance at a third time point and a fourth time point. The third and fourth time points may be separated by a predetermined amount of time (e.g., a second predetermined amount of time). The second predetermined amount of time may be equal to the first predetermined amount of time. In some embodiments, the second predetermined amount of time is different from the first predetermined amount of time.

In an alternate embodiment, the controller may store a first predetermined operating temperature and a second predetermined operating temperature. The second predetermined operating temperature may be greater than the first predetermined operating temperature. The controller may start a timer when the inlet temperature of heated air entering the drum of the dryer reaches the first predetermined operating temperature. The controller may then stop the timer when the inlet temperature of heated air entering the drum of the dryer reaches the second predetermined operating temperature. The controller may then calculate and store the amount of time measured by the timer. If the amount of time measured by the timer is less than a predetermined amount of time, the controller may determine that the dryer is operating in the restricted condition.

Figure 5:
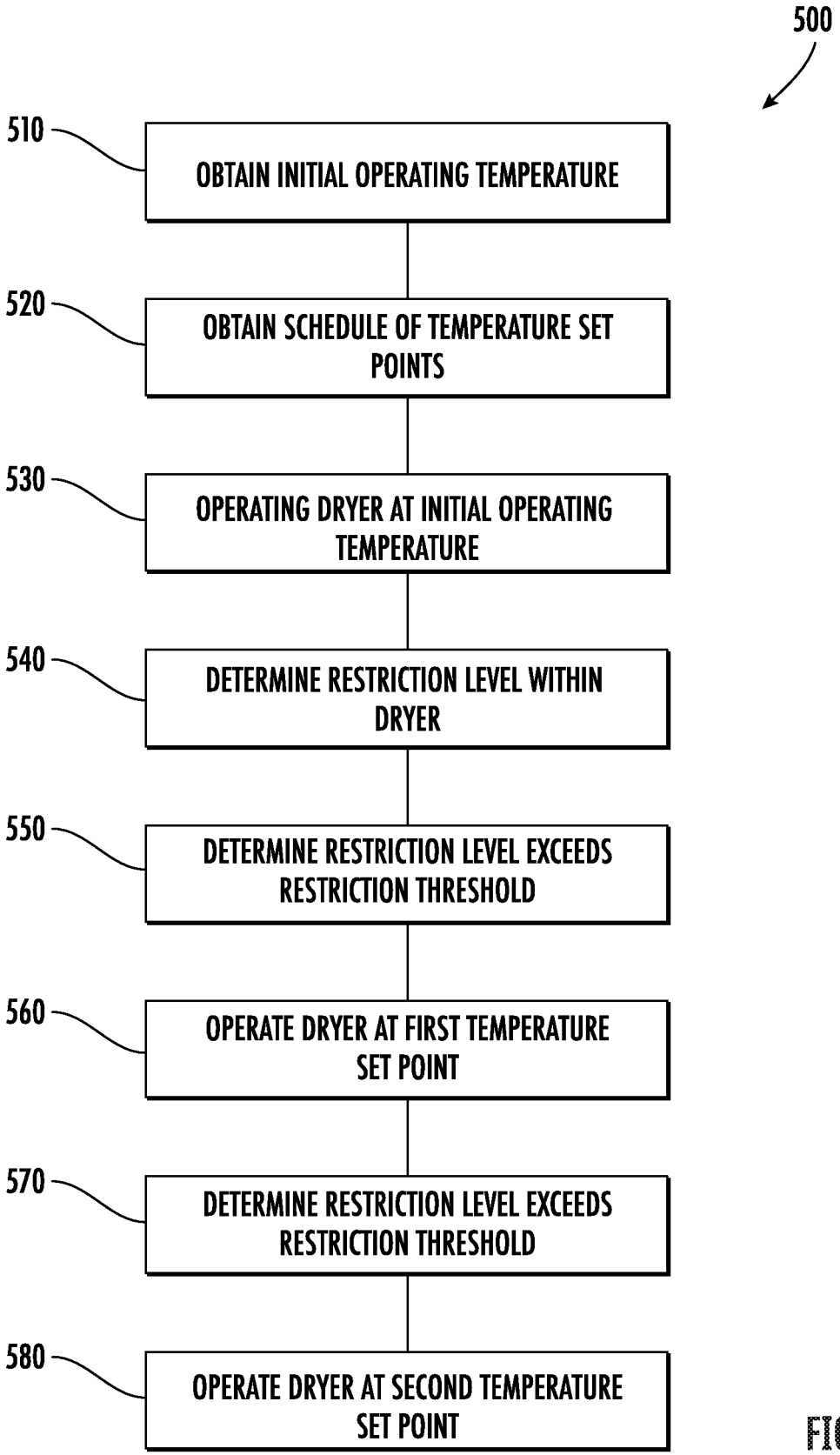
FIG. 5 provides a flow chart illustrating a method of operating the exemplary dryer appliance of FIG. 1.

FIG. 5 illustrates an exemplary method 500 of operating a dryer appliance according to an exemplary embodiment of the present subject matter. Method 500 may be used to operate any suitable dryer appliance. For example, method 500 may be used to operate dryer appliance 10 of FIG. 1. In particular, controller 56 may be programmed to implement method 500.

At 510, the method 500 includes obtaining an initial operating temperature. The initial operating temperature may be a temperature at which the drying cycle is started. For example, the controller may operate the fan and the heating assembly to control a temperature of air entering the drum of the dryer appliance. The initial operating temperature may vary according to an operation selected by a user. For example, the initial operating temperature may be higher for an operation involving cotton or mixed loads, and the initial operating temperature may be lower for an operation involving delicate loads. In one example, there are four different initial operating temperatures. It should be apparent that any number of initial operating temperatures may be programmed into the controller.

At 520, the method 500 includes obtaining a schedule of temperature set points. The schedule of temperature set points may vary according to the initial operating temperature. For example, one initial operating temperature may be associated with a "high" operation. In this example, the initial operating temperature may be about 350° F. For another example, another initial operating temperature may be associated with a "low" operation. In this example, the initial operating temperature may be about 200° F. A first schedule of temperature set points may be associated with the "high" operation. A second schedule of temperature set points may be associated with the "low" operation. The first schedule and the second schedule may be different from each other. In other words, the temperature set points in the first schedule may be different from the temperature set points in the second schedule.

Notably, it may be desirable that the first temperature set point, the second temperature set point, or other temperature set points depend at least in part on the initial operating temperature. In this regard, the maximum permissible or desirable operating temperatures may depend in part on the load type, operating cycle, or temperature levels initially selected by a user. For example, as shown in the table below (Table 1), if a user selects a cotton load, an initial operating temperature of "high," or selects a specific operating temperature, controller 56 may access a lookup table to determine associated temperature set points in the event a restriction condition is detected. By contrast, if a user selects a delicate load cycle, an initial operating temperature of "low," or selects a specific operating temperature, controller may access a different lookup table, with alternative temperature set points associated with that specific cycle or starting temperature. It should be appreciated that these cycle designations, set points, and temperatures are only exemplary and may vary while remaining within the scope of the present subject matter.

TABLE 1

| User Input | Cotton Unrestricted High (270° F.) | Cotton Restricted High (270° F.) |
|---|---|---|
| First Temperature Set Point | Medium (250° F.) | Medium (220° F.) |
| Second Temperature Set Point | Low (230° F.) | Low (200° F.) |
| Third Temperature Set Point | Extra Low (200° F.) | Extra Low (180° F.) |

The schedule of temperature set points may include the first temperature set point and the second temperature set point. The schedule of temperature set points associated with the "high" initial operating temperature may include temperatures successively decreasing from the initial operating temperature. In one example, the schedule of temperature set points includes the first temperature set point, the second temperature set point, a third temperature set point, and a fourth temperature set point. The first temperature set point may be less than the initial operating temperature. The second temperature set point may be less than the first temperature set point. The third temperature set point may be less than the second temperature set point. The fourth temperature set point may be less than the third temperature set point. It should be understood that the schedule of temperature set points may include any number of temperature set points.

At 530, the method 500 includes operating the dryer at the initial operating temperature. The controller may activate the motor, the fan, and the heating assembly of the dryer appliance to run the drying cycle. Alternately, one or more of the motor, the fan, and the heating assembly may be activated. The controller may control a speed setting of the fan in order to circulate air through the duct and the drum of the dryer appliance. Additionally or alternatively, the controller may control an operation cycle of the heating assembly. In detail, the controller may alternately turn on and off the heating assembly to control the temperature of the air entering the drum.

At 540, the method 500 includes determining a restriction level within the dryer appliance. The restriction level may be determined by measuring an inlet temperature of heated air entering the drum at a first time point, measuring an inlet temperature of heated air entering the drum at a second time point, and comparing the difference between the temperature measured at the first point and the temperature measured at the second point to the amount of time between the first time point and the second time point. Similar to the method 400 described above with respect to FIG. 4, the restriction level may be a temperature rate change between the first time point and the second time point. The restriction level may then be compared to a predetermined restriction threshold. The restriction threshold may be a predetermined temperature rate change (e.g., a first temperature rate change) programmed in the controller.

At 550, the method 500 includes determining that the restriction level exceeds the restriction threshold. The controller may compare the calculated restriction level with the predetermined restriction threshold. The controller may then determine that the dryer appliance is operating in a restricted condition. The restricted condition may be a condition indicating reduced air flow through the duct.

At 560, the method 500 includes operating the dryer appliance at the first temperature set point. Upon determining that the dryer appliance is operating in the restricted condition, the controller may reduce the operating temperature of the dryer appliance to the first temperature set point. The first temperature set point may be less than the initial operating temperature. The first temperature set point may be retrieved from the schedule of temperature set points. In order to operate the dryer appliance at the first temperature set point, the controller may cycle the heating assembly. The cycling of the heating assembly may include alternately activating and deactivating the heating assembly. Additionally or alternatively, the cycling of the heating assembly may include operating the heating assembly at a reduced power level. Additionally or alternatively, the controller may control a rotational speed of the fan in order to operate the dryer appliance at the first temperature set point.

At 570, the method 500 includes determining the restriction level exceeds the restriction threshold. Upon operating the dryer appliance at the first temperature set point, the controller may measure an inlet temperature of heated air entering the drum at a third time point, measure an inlet temperature of heated air entering the drum at a fourth time point, and compare the difference between the temperature measured at the third time point and the temperature measured at the fourth time point to the amount of time between the third time point and the fourth time point. Similar to the method 400 described above with respect to FIG. 4, the restriction level may be a temperature rate change between the third time point and the fourth time point. The restriction level may be a predetermined temperature rate change (e.g., a second predetermined temperature rate change) programmed in the controller. The second predetermined temperature rate change may be equal to the first predetermined temperature rate change.

At 580, the method 500 includes operating the dryer appliance at the second temperature set point. Upon determining that the dryer appliance is still operating in the restricted condition or has again reached such a condition, the controller may reduce the operating temperature of the dryer appliance to the second temperature set point. The second temperature set point may be less than the first temperature set point. The second temperature set point may be retrieved from the schedule of temperature set points. In order to operate the dryer appliance at the second temperature set point, the controller may cycle the heating assembly. The cycling of the heating assembly may include alternately activating and deactivating the heating assembly. Additionally or alternatively, the cycling of the heating assembly may include operating the heating assembly at a reduced power level. Additionally or alternatively, the controller may control a rotational speed of the fan in order to operate the dryer appliance at the first temperature set point.

As mentioned previously, the restriction level determined at each of the initial operating temperature, the first temperature set point, and the second temperature set point may be equal. In other words, the restriction level is a predetermined temperature rate change. Likewise, the restriction threshold may be a single predetermined temperature rate change against which the restriction level is compared. The comparison may be performed at each temperature set point at which the dryer appliance is operated. As such, an inlet temperature of heated air introduced into the drum may be continuously monitored. This may lead to safer operation temperatures of the dryer appliance while also maintaining drying efficiency by not unnecessarily deactivating the heating assembly.

Figure 6:
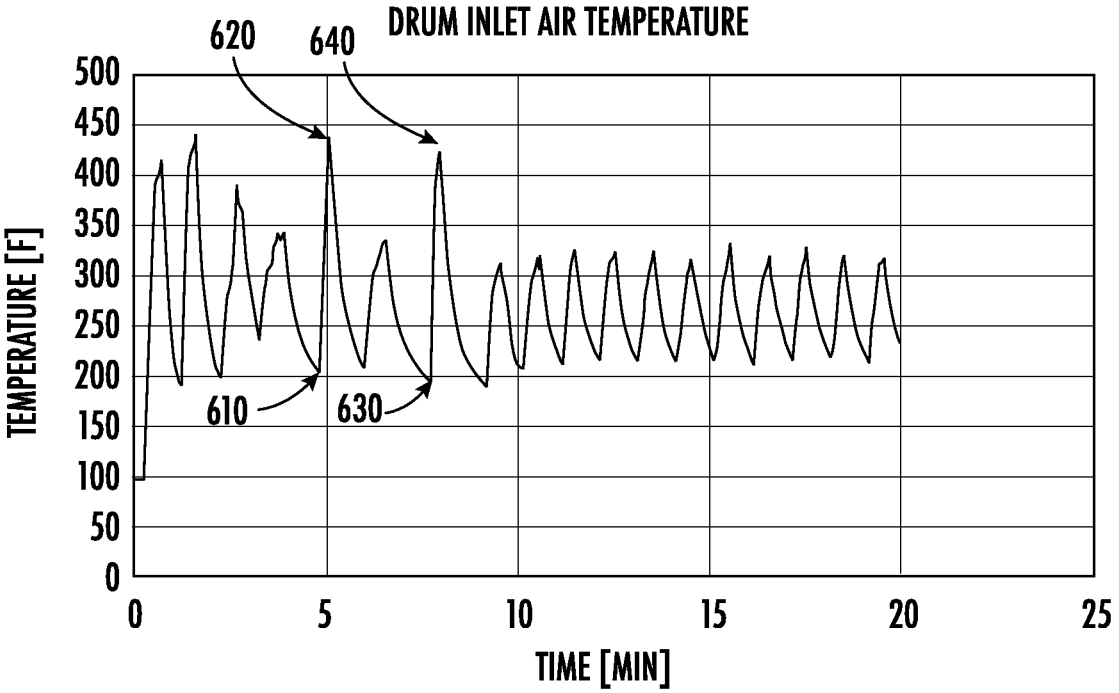
FIG. 6 illustrates a graph of time versus exemplary temperature measurements of a temperature sensor.

FIG. 6 illustrates a graph of time versus exemplary temperature measurements of a temperature sensor. As seen in FIG. 6, 610 may refer to the first time point, 620 may refer to the second time point, 630 may refer to the third time point, and 640 may refer to the fourth time point. As mentioned above with respect to 410, an inlet temperature of heated air entering the drum 26 is measured at the first time point 610. The inlet temperature of heated air entering the drum 26 is measured again at the second time point 620. The slope of the temperature line between point 610 and point 620 may be the restriction level. Controller 56 may then calculate the restriction level (i.e., the slope of the temperature line between point 610 and point 620). Controller 56 may then compare the restriction level to the restriction threshold and determine that the restriction level exceeds the restriction threshold between points 610 and 620.

Subsequently, controller 56 may operate dryer appliance 10 at the first temperature set point. The first temperature set point may be retrieved from the corresponding schedule. Controller 56 may then measure an inlet temperature of heated air entering the drum 26 at the third time point 630 and the fourth time point 640. The slope of the temperature line between point 630 and point 640 may be the restriction level calculated while the dryer appliance 10 is operated at the first temperature set point. Controller 56 may determine that the restriction level still exceeds the restriction threshold between points 630 and 640, indicating that a restriction is still present. Controller 56 may then operate dryer appliance 10 at the second temperature set point. The second temperature set point may be retrieved from the corresponding schedule. Controller 56 may continue to reduce the operating temperature of dryer appliance 10 in like fashion until a calculated restriction level does not exceed the restriction threshold.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a dryer appliance, comprising:
obtaining an initial operating temperature;
obtaining a first temperature set point lower than the initial operating temperature, wherein the first temperature set point is based at least in part on the initial operating temperature;
operating the dryer appliance at the initial operating temperature;
determining a restriction level within the dryer appliance;
determining that the restriction level exceeds a restriction threshold while operating the dryer appliance at the initial operating temperature;
operating the dryer appliance at the first temperature set point upon determining that the restriction level exceeds the restriction threshold while operating the dryer appliance at the initial operating temperature;
obtaining a second temperature set point lower than the first temperature set point, wherein the second temperature set point is based at least in part on the initial operating temperature;
determining that the restriction level exceeds the restriction threshold while operating the dryer appliance at the first temperature set point; and
operating the dryer appliance at the second temperature set point upon determining that the restriction level exceeds the restriction threshold while operating the dryer appliance at the first temperature set point.

2. The method of claim 1, further comprising:
obtaining a schedule of temperature set points including the first and second temperature set points, wherein the schedule of temperature set points is based at least in part on the initial operating temperature.

3. The method of claim 1, wherein operating the dryer appliance at the first temperature set point comprises:
measuring an inlet temperature of heated air entering a drum of the dryer appliance; and
operating the dryer appliance such that the inlet temperature reaches the first temperature set point.

4. The method of claim 3, wherein determining the restriction level comprises:
determining that a rate of change of a temperature of heated air entering the drum of the dryer appliance is above a predetermined rate.

5. The method of claim 4, wherein determining that the rate of change of the temperature of the heated air entering the drum of the dryer appliance is above a predetermined rate comprises:
measuring a first predetermined inlet temperature of heated air entering the drum of the dryer appliance at a first time point;
measuring a second predetermined inlet temperature of heated air entering the drum of the dryer appliance at a second time point;
determining that an amount of elapsed time between the first time point and the second time point is below a predetermined amount of elapsed time.

6. The method of claim 4, wherein the first temperature set point is a predetermined percentage of the initial operating temperature, and the second temperature set point is a predetermined percentage of the first temperature set point.

7. The method of claim 6, wherein the first and second temperature set points are measured at an air inlet to the drum of the dryer appliance by a thermistor in communication with a controller.

8. The method of claim 1, wherein the restriction threshold is between 100° F. per minute and 200° F. per minute.

9. The method of claim 1, wherein the operating the dryer appliance at the second temperature set point comprises cycling a heater between a partially on state and a fully off state.

10. A dryer appliance, comprising:
a cabinet;
a drum rotatably mounted within the cabinet, the drum defining a chamber for receipt of laundry items;
a heater for heating an air supply;
a duct fluidly connecting the heater and the drum;
a temperature sensor positioned within the duct proximate the drum; and
a controller in operative communication with the heating assembly and the temperature sensor, the controller configured for:
obtaining an initial operating temperature;
obtaining a first temperature set point and a second temperature set point lower than the first temperature set point, wherein the first temperature set point and the second temperature set point are based at least in part on the initial operating temperature;

operating the dryer appliance at the initial operating temperature;

determining a restriction level within the dryer appliance;

determining that the restriction level exceeds a restriction threshold while operating the dryer appliance at the initial operating temperature; and operating the dryer appliance at the first temperature set point upon determining that the restriction level exceeds the restriction threshold while operating the dryer appliance at the initial operating temperature; wherein the controller is further configured for: determining that the restriction level exceeds the restriction threshold while operating the dryer appliance at the first temperature set point; and operating the dryer appliance at the second temperature set point upon determining that the restriction level exceeds the restriction threshold while operating the dryer appliance at the first temperature set point.

11. The dryer appliance of claim 10, wherein the controller is further configured for:

obtaining a schedule of temperature set points including the first and second temperature set points, wherein the schedule of temperature set points is based at least in part on the initial operating temperature.

12. The dryer appliance of claim 10, wherein operating the dryer appliance at the first temperature set point comprises:

measuring an inlet temperature of heated air entering the drum of the dryer appliance; and operating the dryer appliance such that the inlet temperature reaches the first temperature set point.

13. The dryer appliance of claim 12, wherein determining the restriction level comprises:

determining that a rate of change of a temperature of heated air entering the drum of the dryer appliance is above a predetermined rate.

14. The dryer appliance of claim 13, wherein determining that the rate of change of the temperature of the heated air entering the drum of the dryer appliance is above a predetermined rate comprises:

measuring a first predetermined inlet temperature of heated air entering the drum of the dryer appliance at a first time point;

measuring a second predetermined inlet temperature of heated air entering the drum of the dryer appliance at a second time point;

determining that an amount of elapsed time between the first time point and the second time point is below a predetermined amount of elapsed time.

15. The dryer appliance of claim 13, wherein the first temperature set point is a predetermined percentage of the initial operating temperature, and the second temperature set point is a predetermined percentage of the first temperature set point.

16. The dryer appliance of claim 15, wherein the first and second temperature set points are measured at an air inlet to the drum of the dryer appliance by the temperature sensor.

17. The dryer appliance of claim 10, wherein the restriction threshold is between 100° F. per minute and 200° F. per minute.

18. The dryer appliance of claim 10, wherein the operating the dryer appliance at the second temperature set point comprises cycling the heater between a partially on state and a fully off state.

* * * * *